US005154597A

United States Patent [19]

Füllemann et al.

[11] Patent Number: 5,154,597

[45] Date of Patent: Oct. 13, 1992

[54] BURNER FOR COMBUSTION OF GASIFIED LIQUID FUELS

[75] Inventors: Jörg Füllemann, Mastrils; Heinrich Boner, Malans, both of Switzerland

[73] Assignee: VTH AG Verfahrenstechnik fur Heizung, Vaduz, Liechtenstein

[21] Appl. No.: 573,401

[22] Filed: Aug. 24, 1990

Related U.S. Application Data

[63] Continuation-in-part of Ser. No. 167,300, Mar. 11, 1988, Pat. No. 4,957,427, and a continuation-in-part of Ser. No. 358,673, May 30, 1989, Pat. No. 5,015,173.

[30] Foreign Application Priority Data

| | | | |
|---|---|---|---|
| Mar. 13, 1987 | [CH] | Switzerland | 958/87 |
| Feb. 25, 1988 | [EP] | European Pat. Off. | 88810113.6 |
| Jun. 9, 1988 | [CH] | Switzerland | 02201/88 |

[51] Int. Cl.[5] ..... F23J 5/02

[52] U.S. Cl. ..... 431/116; 431/168; 431/350; 431/354; 431/208; 431/243

[58] Field of Search ..... 431/116, 214, 208, 115, 431/242, 243, 168, 350, 348, 354

[56] References Cited

U.S. PATENT DOCUMENTS

| | | | |
|---|---|---|---|
| 1,755,846 | 4/1930 | Steed | 431/208 |
| 2,568,763 | 9/1951 | Ray | 431/208 |
| 2,867,270 | 1/1959 | Brzozowski | 431/116 |
| 4,624,631 | 11/1986 | Kobayashi et al. | 431/350 X |
| 4,712,997 | 12/1987 | Füllemann et al. | 431/116 X |
| 4,957,427 | 9/1990 | Füllemann et al. | 431/116 X |
| 5,015,173 | 5/1991 | Füllemann et al. | 431/116 |

FOREIGN PATENT DOCUMENTS

| | | | |
|---|---|---|---|
| 1401127 | 12/1968 | Fed. Rep. of Germany | 431/116 |
| 55-123911 | 9/1980 | Japan . | |
| 59-95311 | 6/1984 | Japan . | |
| 60-200012 | 10/1985 | Japan . | |
| 62-186114 | 8/1987 | Japan . | |
| 0910505 | 11/1962 | United Kingdom | 431/116 |

*Primary Examiner*—Carl D. Price

*Attorney, Agent, or Firm*—Frishauf, Holtz, Goodman & Woodward

[57] ABSTRACT

A gasifier (17) is located at a distance (49) from an air aperture plate (35). At the outlet (42) of the gasifier there is a stationary mixing head (29) having a deflector section (31) and lateral outlets (33). Fuel is supplied coaxially through an opening (55) of the air aperture plate. A flame tube (21) surrounds the gasifier (17) and an electric heater (39) leaving an annular space (40). When the burner is started up, the electric heater (39) is switched on until the gasifier has the necessary operating temperature. Fuel is then supplied. The fuel/air mixture is ignited by an electrode (65). The flame tube (21) extends to the end of the mixing head (29), or only a little therebeyond. A flame is formed at the outlets (33) that touches the flame tube after a short travel, then emerges from it and expands. Because the flame can immediately expand, only little $NO_x$ is formed. A portion of the hot combustion gases is recirculated through the annular space (40) and sucked into the gasifier to heat the gasifier (17) after the shutoff of the electric heater (39).

33 Claims, 4 Drawing Sheets

BURNER FOR COMBUSTION OF GASIFIED LIQUID FUELS

This application is a continuation-in-part of application U.S. Ser. No. 07/167,300, filed Mar. 11, 1988, now U.S. Pat. No. 4,957,427 and claiming priority of Swiss Application 958/87 of Mar. 13, 1987, and also of U.S. application Ser. No. 07/358,673, filed Mar. 30, 1989, now U.S. Pat. No. 5,015,173 and claiming priority of Swiss Application 02 201/88 of Jun. 9, 1988.

FIELD OF THE INVENTION

The invention relates to a burner for the combustion of liquid fuel having a gasifier, a flame tube, and a fuel supply to the gasifier.

BACKGROUND

German Patent Disclosure Document 26 49 669 discloses a burner having a combustion chamber in which a rotating gasifier pot is located in the front region thereof. The gasifier has a bottom and a tubular portion. The output opening of the gasifier pot is located at an axial distance from the front wall of the combustion chamber. The tubular portion of the gasifier pot is enclosed at a radial by an annular diversion chamber to form an injector channel for air flow.

If a sufficient over-supply of air is provided, a good mixture of fuel and combustion air can be obtained, which is indicated by a blue flame. This is also referred to in German Patent 33 46 431, discussing the structure of the aforementioned German Patent 26 49 669. In continuous operation, a high over-supply of air, however, is not permissible because the $CO_2$-value and the combustion efficiency will not meet desired requirements. The additional air disturbs the heat balance in such a way that condensation can take place on the back wall. When operating close to the stoichiometric region, an insufficient mixture of oil vapor, fresh air and combustion gases will result. If, to improve operations, baffles or bypasses are inserted, or a change of the injector geometry is made, the injector action is undesirably affected. This causes reduction in recirculation of combustion gases. Additionally, the temperature balance is negatively affected, and condensation effects as well as impermissible high increases in $NO_x$ and CO gases take place.

A distinction is made between atomizing burners and gasification burners. In atomizing burners, the fuel is atomized with a nozzle and combusted in a combustion chamber into which air is supplied. Since the atomizing output of the nozzle can be varied only within narrow limits, atomizing burners have the disadvantage that their output cannot be continuously controlled. Nor can they be built for very small heat requirements. The smallest nozzles are dimensioned for an oil throughput of approximately 1.4 kilograms per hour. Because the output of atomizing burners cannot be varied continuously, atomizing burners are operated intermittently whenever the heat requirement is low. Since the intervals between periods of operation cannot be made arbitrarily brief, relatively large boilers are required as energy storage means. Intermittent operation has the disadvantage that switching the burner on and off repeatedly causes severe alternating temperature stresses on the materials, as well as a high burden of soot and toxic substances for the boiler, chimney and environment. Incomplete combustion and soot formation, which occur particularly in the startup phase, are highly detrimental to the overall efficiency of a heating system. Radiation losses in the large boilers contribute further to reducing overall efficiency.

In contrast to the atomizing burners described above, gasification burners as a rule have the advantage that they can be controlled continuously, down to very low outputs, in accordance with the heat requirement. In the combustion of gasified fuel, the emission of toxic substances, such as uncombusted hydrocarbons and soot, is also reduced considerably.

Despite the many advantages of gasification burners, they are used only to a limited extent. One major reason for this is that most gasification burners require a great deal of maintenance. In gasification burners, undesirable deposits generally tend to form in the gasification chamber, which soon impair gasification efficiency and hence burner operation considerably.

In U.S. Pat. No. 4,421,475, a gasification burner having an electrically heatable gasification chamber is described. The temperature of this gasification chamber is measured by a temperature sensor and kept at an optimal value by means of a control device, to prevent fuel carbonization. A further provision for avoiding carbonization is that the gasification chamber has no air inlet openings. Furthermore, a rotatable cleaning device in the form of a wiper is housed in the gasification chamber. This wiper serves to distribute the fuel finely over the heated gasifier walls and prevent deposits from forming, so as to avoid the detrimental influence of deposits on fuel evaporation. The gas formed in the gasification chamber leaves the chamber at relatively high speed through a nozzle. The air required for combustion is provided by a fan. The burner described has the disadvantage of requiring a relatively large amount of electrical energy for evaporation of the fuel. Burners of this type are also relatively expensive, because they require a temperature sensor and a temperature controller. Compared with other gasification burners, where the mixing of fuel and air takes place prior to combustion in the combustion chamber, the combustion of the gas emerging from a nozzle at relatively high speed has the disadvantage of generating a relatively large amount of noise. Cold starting problems can also arise, because the air is not heated, or is heated only insignificantly, prior to the combustion. Another disadvantage is that upon shutoff, gasified fuel can continue to burn with a sooty flame. It is also possible for still-uncombusted hydrocarbons to emerge from the gasification chamber after the shutoff.

European Patent No. 0 067 271 discloses a continuously controllable oil burner with an electrically heated evaporation device having air inlets, which is monitored by a thermostat. This evaporation device is in the form of a beaker, with air inlets provided on the bottom of the beaker. A rotating cylinder for oil distribution is located in this beaker. This cylinder fills the entire evaporation chamber in the beaker except for a small gap. For oil distribution, oil is supplied to the rotating cylinder via a hollow drive shaft, and then ejected by centrifugal force from the radial bores in the rotating cylinder onto the inner walls of the evaporation chamber. Oil burners of this type have not attained commercial application, however. A disadvantage is that the gasification chamber tends to become soiled, which impairs the entry of air or the exit of the air and gas mixture. Since the pressure difference between the air inlet and the air and gas mixture outlet is very small, even slight soiling results in a sooty flame. Another disadvantage is that the rotating cylinder absorbs a large quantity of heat via the cylinder surface and transmits it via the drive shaft to the drive motor, which can be damaged thereby, unless expensive provisions for protecting it are made. The necessity for thermostat monitoring of the gasifier contributes further to increasing the initial cost of the burner.

U.S. Pat. No. 3,640,673 described a burner for a kerosene stove in which a fan is located in the gasification chamber, which is heatable electrically and by the flame of the burner. A relatively large space exists between the periphery of the fan and the heated wall surface of the gasification chamber. An atomizer plate for the fuel is located on the drive shaft for the fan. When fuel is sprayed onto the atomizer plate during operation, the plate distributes the fuel into fine droplets, which are spun outward by centrifugal force. In this process they are mixed by the fan with the preheated air flowing into the gasification chamber. Since the distance between the periphery of the fan and the heated wall face of the gasification chamber is relatively large, most of the fuel droplets evaporate without ever coming into contact with the wall surface. The few fuel droplets that do strike the heated wall of the gasification chamber then evaporate there. It is disadvantageous that deposits form on the wall, which impair the evaporation, especially in the startup phase, when the gasification chamber is heated only electrically. This can then cause startup problems. Furthermore, uncombusted hydrocarbons occur both in the startup phase and in the shutoff phase. A further advantage of the described burner is that it can be operated only with kerosene, is practically an atmospheric burner, and thus is unsuitable for use with a boiler.

European Patent Application No. 0 166 329 of Füllemann, which was published on Jan. 2, 1986, describes a gasification burner in which a rotor, provided with blades that extend to the vicinity of the heatable wall of the gasification chamber, is provided. The gasification chamber has an air inlet. The fuel supplied via the rotor shaft is finely distributed by the rotor and mixed with compressed air, evaporating in the hot gasification chamber. The mixture can escape at relatively high pressure through openings in a burner plate and burns with a low-noise, blue flame.

For the sake of completeness, the oil burner described in Swiss Patent 628 724 should also be noted, which although it is an atomizing burner also shares some characteristics of a gasification burner. It has the intrinsic disadvantage of atomizing burners of not being controllable over a wide output range. Even in the lowest output range, it still requires a relatively high throughput of 1.6 to 2.1 kilograms of oil per hour.

For gasification of the atomized oil droplets, a mixing tube and a flame tube are provided coaxially with the nozzle. In operation, the oil is injected through the nozzle into the mixing tube, into which the air required for combustion is also known. A flame then forms at the end of the mixing tube. A portion of the hot combustion gases is then recirculated to the beginning of the mixing tube and mixed there with the mixture of atomized oil and air for the sake of heat exchange. Because of the recirculation of a portion of the combustion gases, this burner enables extensive gasification of the oil droplets in the mixing tube and thus better combustion with less soot. However, this advantage is attained at the cost of an increased formation of nitrogen oxides ($NO_x$). The burner in fact required a long flame tube. Since expansion of the flame takes place only after it emerges from the flame tube, there is a relatively large flame zone at very high temperatures, which favors the formation of nitrogen oxides. As already mentioned, the burner also has the disadvantage of not being controllable over a wide output range. In the lowest output range, it requires a relatively high oil throughput of 1.6 liters per hour. This burner has additional problems in start-up and shutoff, a factor that is all the more serious since the burner has to be operated intermittently. One problem in startup is the ignition of the oil droplets flowing out of the atomizer nozzle. Unlike a conventional atomizing burner, optimal disposition of the ignition electrodes is prevented in this case by a wall having an air aperture plate. Hence there is a great danger that ignition will not occur even in repeated starting attempts. A further problem is that at startup, the mixing tube is cold and thus has no evaporation capacity. The flame is therefore extremely sooty until the mixing tube has attained a high temperature and is capable of evaporating the oil that strikes it. When the burner is shut off, the oil dripping from the nozzle continues to burn with an extremely sooty flame. Since at shutoff the mixing tube located near the nozzle is still red-hot, a great deal of heat radiates from toward the nozzle, which can lead to carbonization of fuel in the nozzle. This can clog the nozzle, especially when it is small.

German Patent Disclosure 3 346 431 discloses a burner having a rotating evaporator cup. This cup is closed on the flame side and has an outlet for the evaporated fuel only on the motor side. The evaporator cup is surrounded by an annular deflection chamber for the air supply. Gasified fuel and air then flow between the evaporator cup and the flame tube in two concentric flows of annular cross section, strike a baffle ring, mix, and then form a flame. The disadvantage is that the evaporator chamber is not subjected to a forceful flow of hot gases, and so deposits form there that soon impair the function of the burner. In particular, a major emission of uncombusted hydrocarbons occurs upon shut off of the burner.

French Patent 2 269 029 also discloses a burner having a rotating evaporator cup that is closed on the flame side. The evaporator cup is lined on the inside with a wire mesh, which serves to prevent an outflow of the fuel. This burner needs a strong blower that requires a relatively large amount of energy, because the fresh air and the air and gas mixture are deflected several times. Another disadvantage is that after shutoff of the burner, a large amount of fuel is still evaporating from the wire mesh, which was previously swept with air and therefore has remained relatively cool; once again, a major emission of hydrocarbons is the result.

U.S. Pat. No. 2,535,316 discloses a burner having a spherical gasification chamber, which rotates slowly. The fuel flowing through a line forms an oil bath at the bottom of the chamber, from which the lighter fractions evaporate. The remaining tar and coke residue forms a thin layer on the chamber wall, and with the slow rotation of the chamber, this layer migrates slowly upward. There, a flow of air meets this layer and burns it off continuously. The disadvantage here is that when the burner is shut off the oil bath causes a major emission of soot, tar and uncombusted hydrocarbons.

THE INVENTION

It is an object to provide a burner that largely overcomes the aforementioned disadvantages of the known burners. It is intended to enable operation at low outputs and/or to enable adaptation of the output to the heating requirement, as well as to be operationally dependable and require little maintenance. It should also meet stringent environmental protection regulations, for example assuring clean combustion while in operation, with low nitrogen oxide emissions, and emitting no uncombusted hydrocarbons upon startup and shutoff.

Briefly, the burner has the gasifier formed as a hollow body. An inlet for air is provided to the gasifier and an outlet therefrom. Fuel is supplied to the interior of the hollow body of the gasifier. The gasifier is coupled to a hollow mixing head which is formed with outlet openings at the outer walls thereof to intimately mix the combustible gas-air mixture issuing from the gasifier. The mixing head includes a deflector section positioned to deflect the gas-air mixture through the openings in essentially radial direction to form a flame, after ignition of the combustible gas-air mixture, which expands essentially radially from the mixing head. A flame tube surrounds the gasifier and the mixing head, with space therebetween. The flame tube extends axially approximately to the end of the mixing head, or only a little therebeyond, so that a plane across the end of the flame tube and the plane across the end of the mixing head will be in at least approximate alignment, so that the flame can expand radially shortly after the flame, resulting from ejection of the gas-air mixture through the opening, touches the flame tube. The flame tube is so arranged with respect to the gasifier that a recirculating path of hot combustion gases from the outlet to the inlet is formed.

DRAWINGS

DETAILED DESCRIPTION

Figure 1:
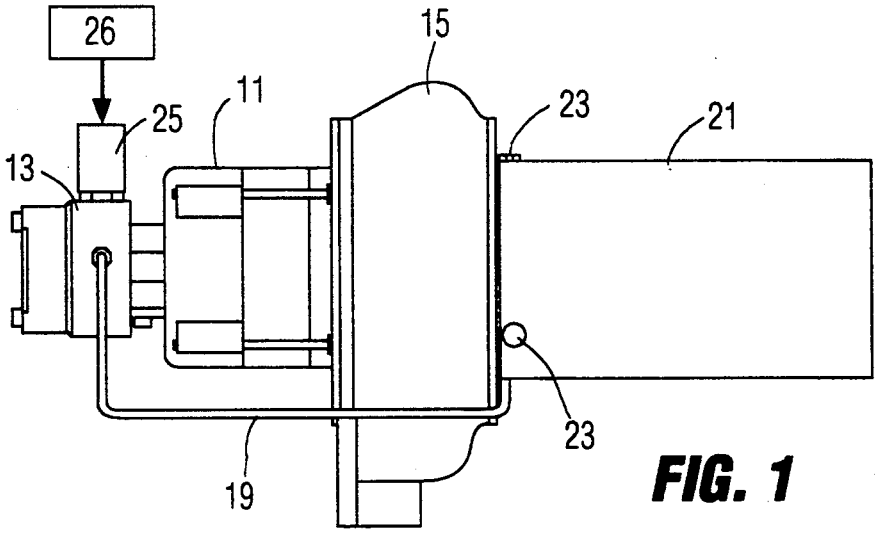
FIG. 1 is a view of the burner according to the invention.
Figure 2:
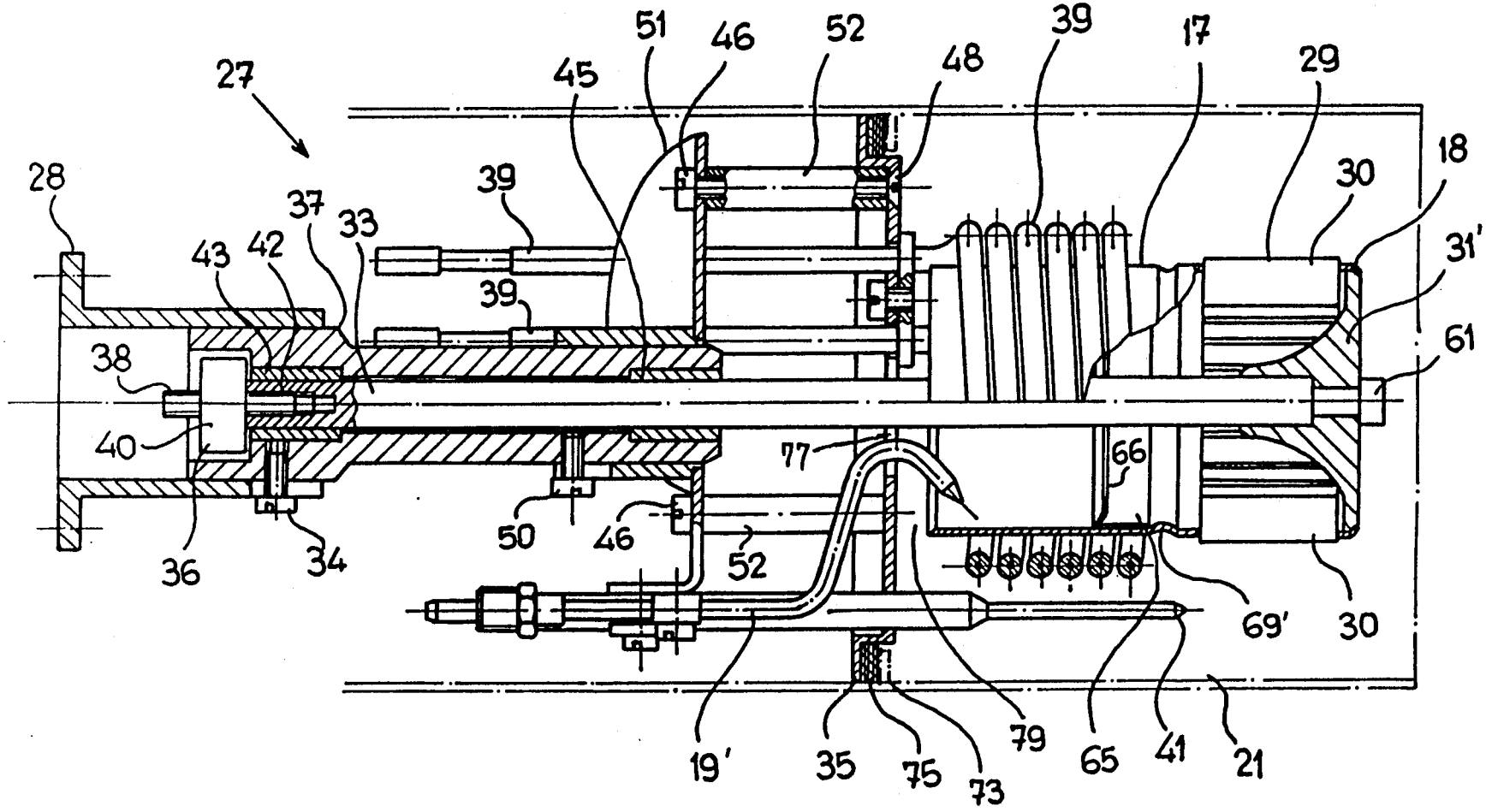
FIG. 2 is an axial cross-sectional view through the burner with a rotating gasifier structure.

The burner shown in FIG. 1 has a motor 11, which is used to drive the fuel pump 13, the fan 15 and the rotatable gasifier 17 (see FIG. 2). From the fuel pump 13, a fuel line 19' (FIG. 1) leads to the gasifier 17 (FIG. 2), which is surrounded by a flame tube 21. The flame tube 21 can be removed easily by loosening the screws 23. A volustat, or fuel volume supply unit, e.g. a magnetic valve or another suitable device 25 is used to control the fuel supply in accordance with control commands of the heating control system 26.

A volustat is an apparatus that, in accordance with an input signal, furnishes a corresponding feed volume per unit of time, this volume being virtually unaffected by resistance in the feed line. The feed volume is also virtually unaffected by the viscosity of the fuel. Volustats are made by the Satronic company in Regensdorf, Switzerland, for example.

EMBODIMENT OF FIGS. 2–4

FIG. 2 shows an easily replaceable component unit 27 which has a rotatable gasifier 17, mixing head 29, a baffle plate 31', a drive shaft 33 for the gasifier 17, an air aperture plate 35, an adapter sleeve 37, a fuel line segment 19', an electric heater 39 and an ignition electrode 41. After assembly, the component unit is surrounded by a flame tube 21. The flame tube is relatively short and, if it protrudes at all, protrudes only a short distance beyond the mixing head 29. The assembly is retained on a support structure by a flange 28.

The drive shaft 33 is supported on the adapter sleeve 37 by two bearings 43, 45, for example sintered bearings. The axial position of the drive shaft is fixed, for example by the setting rings 47, 49. The air aperture plate 35 is secured to the adapted sleeve 37 by the support 51.

The gasifier 17 is formed as a hollow rotational body. The unit 27 includes the gasifier 17, mixing head 29, deflector portion 31', drive shaft 33, aperture plate 35, adapter sleeve 37, fuel line segment 19', electric heater 39 and the ignition electrode. After assembly, the component unit 27 is surrounded by the flame tube 21.

Reference numeral 28 indicates a flange for securing the component unit 27 on the fan 15 (see FIG. 1), which is accomplished by tightening holding screws. The drive shaft 33 is supported in the adaptor sleeve 27 by two bearings 43, 35. The bearing 45 is spaced relatively far apart from the gasifier 17, so that it is well protected from heat. To attain this, an axially adjustable support 51, which can be fixed with a screw 50, is provided on the adapter sleeve 37, having arms or spacer elements 52 for supporting the air aperture plate 35. In operation, the spacing of the air aperture plate 35 apart from the bearing 45 assures that the drive shaft 33 between the bearing 45 and the gasifier 17 is cooled by the fresh air. The spacer elements 52 may for example be connected to the support 51 or the air aperture plate 35 by means of screws 46, 48.

The coupling between the motor 11 and drive shaft 33 is effected via a coupling segment 36, which has a thread 38, a body 40 of elastomeric material and a thread 42. The thread 38 can be screwed into an axial thread in the shaft of the motor 11 (FIG. 1) by rotation at the mixing head 29. The gasifier 17, the mixing head 29 and the deflector portion 31' form a unit 18, which is secured with screw 61 to the drive shaft 33. This unit can be inexpensively manufactured from a tube segment. It can also be manufactured from a piece of sheet metal, which is then rolled into a tube segment and welded at the abutting end or joined in some other manner. In the portion of the tube segment forming the mixing head 29, the deflector portion 31' is then introduced and welded or otherwise joined to the tube segment. The mixing head 29 is formed by the front portion of the tube segment. The mixing head 29 is separated is separated from the gasifier 17 by a constriction 69'. This constriction forms an inwardly oriented barrier, which prevents the liquid fuel from flowing unevaporated into the mixing head.

Figure 3:
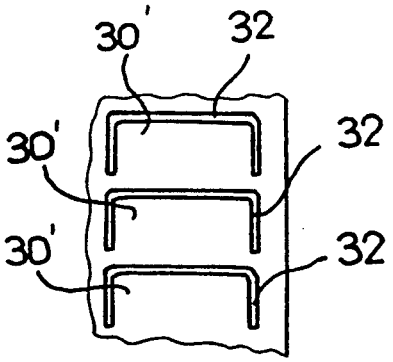
FIG. 3 shows the formation of U-shaped slits to form the openings from the mixing head.
Figure 4:
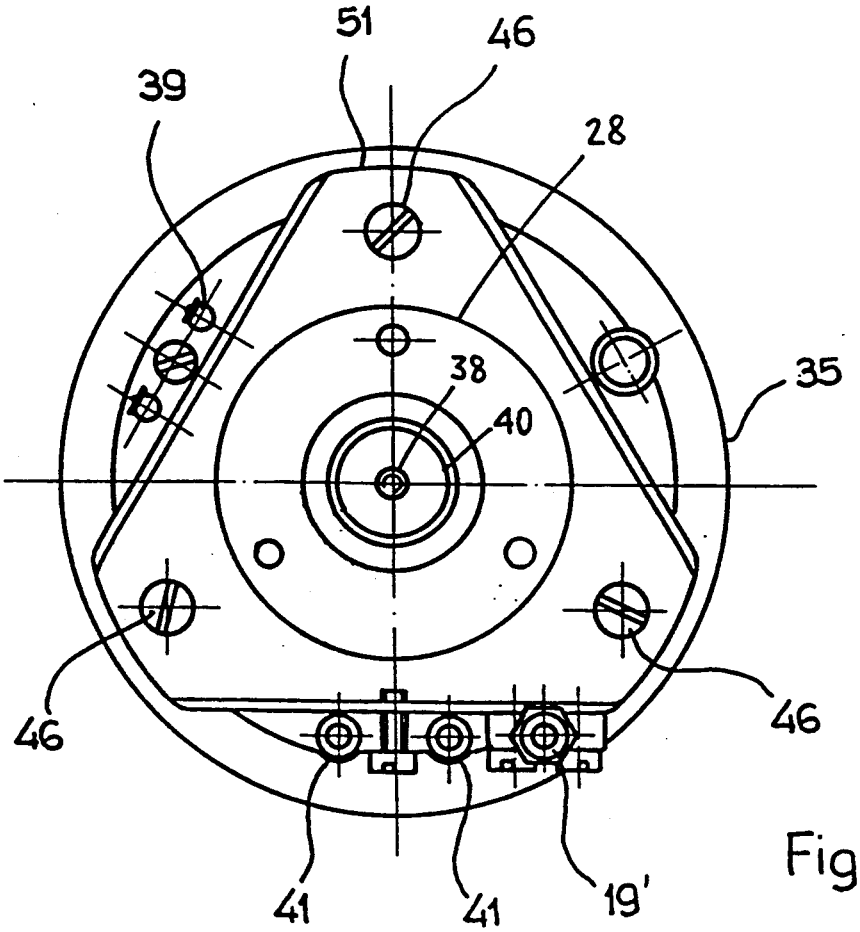
FIG. 4 is a view from the left of the component unit shown in FIG. 2.

The mixing head 29 has blades 30. These blades 30 can be formed out from the wall, by initially forming U-shaped slits 32 (see FIG. 3) in the piece of sheet metal or in the wall and then bending over the tabs 30'. The blades 30 protrude inward and advantageously are located in such a way with respect to the rotational direction of the mixing head 29 that they have the tendency of feeding air from the outside inward. In operation, however, the air flowing through the gasifier counteracts this tendency. As a result, the blades 30 effect an intensive mixing of gasified fuel and air, so that a calm flame is produced at the periphery of the mixing head 29.

An insert 65 (FIG. 2) of metal cloth can be placed in gasifier 17 but may be dispensed with. This is particularly true if the gasifier 17 is relatively long. With a short gasifier 17, it is advantageous to provide a metal cloth insert 65 having an upwardly bent rim 66. This rim is formed as a radial flange that protrudes radially into the gasifier chamber and that intercepts any fuel droplets, so that they evaporate.

An extension ring 73 which presses against a sealing ring 75 at the air aperture plate 35 is located on the flame tube 21. This assures that the air required for combustion can flow only through the central opening 77. Because of the spacing apart of the gasifier 17 from the air aperture plate 35, a recirculation inlet 79 is created.

A fireproof steel is suitable and preferred as the material for the unit 18 and the flame tube 21.

The gasifier advantageously is in the form of a cylindrical tube segment, which substantially facilitates manufacture of the gasifier. For instance, it can be made from cylindrical tube material. The cylindrical embodiment also has the advantage that centrifugal force effects good distribution of the fuel over the entire inner wall. It is therefore sufficient for the fuel supply line to be extended somewhat into the tube segment. The fuel supply line can extend through the inlet of the gasifier into its interior, so that fuel need not be supplied through the drive shaft of the gasifier, which would necessitate a relatively costly type of construction. If desired, however, the fuel supply can be naturally done through the drive shaft.

A nozzle aimed at the gasifier wall is suitably provided at the end of the fuel supply line, extending to near the inner wall of the gasifier or near the surface of the means that increase the surface area. The nozzle is simply a restriction of the fuel line to a cross section of approximately 1 mm, rather than being a kind of atomizer nozzle such as is used in atomizing burners. To prevent fuel from escaping at the ends of the tube segment, a radially inwardly oriented extension 66 is provided at least at the outlet end of the tube segment.

The rotating gasifier can be driven in various ways. For instance, the gasifier can be rotated by the air flow flowing through it. Advantageously, however, the rotatable gasifier has a drive shaft that is coupled to the drive unit, for example the burner motor 11. This assures that when the burner is switched on, the gasifier will rotate. Connecting means, for instance in the form of spokes, are suitably provided, connecting the gasifier to the drive shaft or to a hub mounted on the drive shaft. The spokes are suitably disposed at the outlet. This makes it possible to have a fuel line protrude into the gasifier from the inlet. In that case, practically the entire gasifier wall is available for receiving a metal cloth insert. To enable heating of the gasifier when the burner is switched on, a stationary electric heater 39 is suitably located spaced apart from the rotating gasifier. The gasifier is then heated by radiant heat. A flame tube is then also advantageously disposed coaxially with and spaced apart from the gasifier and from the electric heater.

A gasifier through which air flows has the disadvantage of being severely cooled by the air. If an electric heater had to supply the energy required for gasification continuously, this would consume a considerable amount of electric current. In an exemplary embodiment of the invention, however, a hot gas recirculation inlet 79 is provided for the gasifier. This makes it possible to switch off the electric heater after the startup of the burner, and to draw the gasification heat from the hot gases produced in combustion.

Advantageously, an air aperture plate 35 having an opening 77 for supplying air to the inlet of the gasifier is provided. This air supply opening is suitably located centrally and also serves as a passageway for the drive shaft for the gasifier. The ignition electrode 41', having a tip 41, is located near, but somewhat set back from outlet slits 32 from the mixing head 29. The relatively cold air is thereby deflected into the center of the gasifier.

At least one mixing prong protruding into the gasifier may be provided. This mixing prong creates turbulence which promotes the mixing of the gasified fuel with air. Suitably, a number of mixing prongs are located concentrically about the opening of the air aperture plate. This arrangement provides for particularly good mixing of air with gasified fuel. The air aperture plate 35 is suitably located spaced apart from the gasifier, the gap between the air aperture plate and the gasifier forming the hot gas recirculation inlet 79. Because of this arrangement, it is primarily the hot recirculated gases that sweep along the inside wall of the gasifier, while the cold air flows through the space more in the interior region thereof. Good evaporation of the fuel is thereby attained, and continued evaporation of fuel after the shutoff of the burner is avoided.

In an exemplary embodiment of the invention, a mixing head is located at the outlet of the gasifier. This mixing head rotates together with the gasifier and effects good mixing of gasified fuel and air. The mixing head can be embodied in various ways. For instance, it may be formed by means of a fan wheel, located spaced apart from the outlet and having radial blades. A mixing head of this kind can be manufactured using relatively little sheet metal.

It has proved to be suitable for a preferably slit baffle plate to be spaced apart from the outlet of the gasifier, which promotes recirculation. Slitting of the baffle plate provides that it will be sufficiently well cooled.

An advantageous embodiment provides that the mixing head is formed by a deflector part, spaced apart from the gasifier, having blades extending toward the gasifier. The blades are thus located on the periphery of the mixing head and their pitch is such that they have the tendency to feed air from the outside inward. This is not the case during operation, however, because the air flowing in through the opening of the air aperture plate counteracts this tendency. This embodiment of the mixing head mixes gasified fuel and air particularly well, so that a calm flame is produced at the periphery of the mixing head.

The gasifier advantageously has means that increase its surface area, such as a metal cloth. This increases the effective surface area of the fuel film and accelerates the gasification. If a metal cloth or a porous sintered composition is used, capillary action also becomes operative, which facilitates the distribution of the fuel over the entire gasifier wall. The means for increasing the surface are suitably provided by an insert that lines the inner wall of the hollow body. Such an insert is easy to replace, if necessary, during maintenance work. Since the fuel, upon emerging from the fuel supply line, immediately comes into contact with the metal cloth that increases the surface area, capillary and centrifugal forces immediately become operative there, having the tendency to distribute the fuel over the entire surface of the gasifier interior. Accordingly, there is no danger that fuel droplets will be entrained by the forceful air flow in the gasifier and carried to the outside.

The insert advantageously has a flange that protrudes practically radially inward. As a result, any oil droplets are intercepted and evaporated on the hot surface of the insert.

An advantageous embodiment of the invention provides that the gasifier, the mixing head and the deflector portion form a unit. This unit can then easily be secured with one screw to the drive shaft, which makes maintenance work for the burner easier. Even a person lacking specialized skills is capable of replacing a unit having the gasifier and mixing head in minimum time. That would not be the case, for instance, in replacing a nozzle of a known atomizing burner. The gasifier and mixing head can be made from a single tube segment, for example a piece of sheet metal shaped into a tube segment. This considerably facilitates manufacture and makes it much less expensive. The blades of the mixing head can be formed out from the wall. This can be done by stamping work, for example.

In the described embodiment of the gasifier and mixing head, the blades have a dual function. On the one hand, they serve as means for mixing gasified fuel and air, and on the other hand, they act as connecting bridges between the gasifier and the drive shaft. Separate spokes, such as are required when the gasifier and mixing heads are separate parts, can thus be dispensed with.

The blades suitably protrude inward; this enables forming a relatively calm flame at the mixing head.

The cooling action of the air flowing into the gasifier can be exploited for cooling the drive shaft bearing, by providing a spacing, approximately equivalent to the length of the gasifier, between the gasifier and the bearing.

Figure 5:
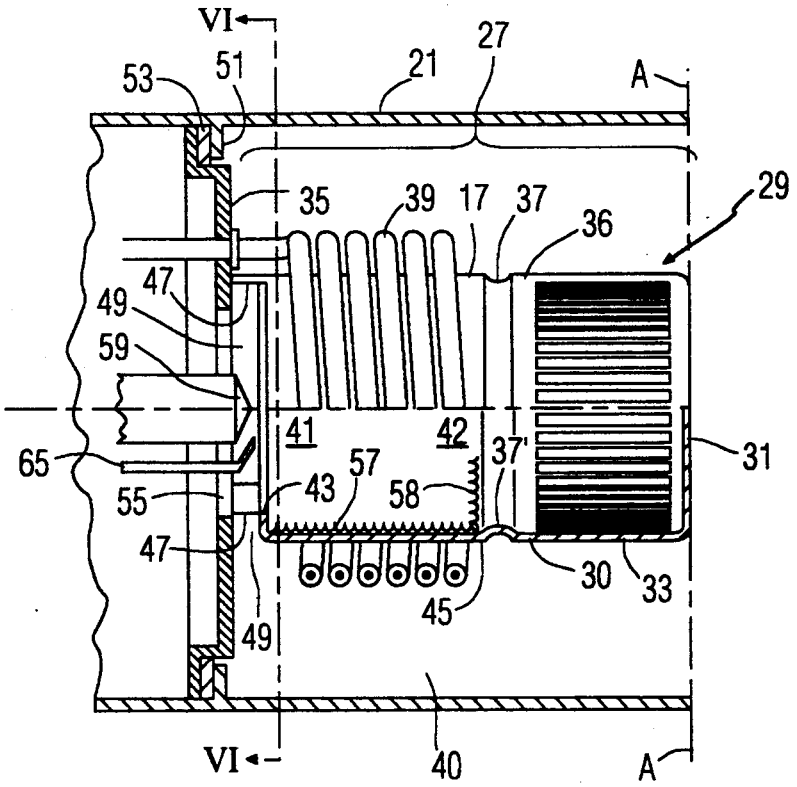
FIG. 5 is an axial cross-sectional view of the burner with a stationary gasifier.
Figure 6:
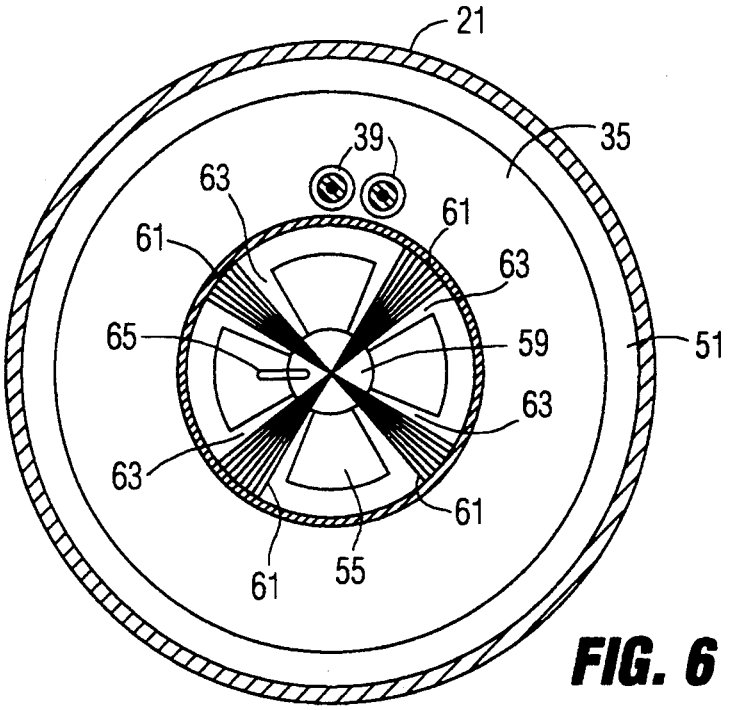
FIG. 6 shows a cross section along line VI—VI of FIG. 5.

FIGS. 5 and 6 illustrate an embodiment in which the easily replaceable component unit 27 uses a stationary gasifier 17. Thus, unit 27 includes the gasifier 17, mixing head 29, air aperture plate 35, electric heater 39 and further optionally connected parts. The mixing head 29 and the gasifier 17 are an integral part which includes a disk-like deflector section 31. The component unit 27 is surrounded by the flame tube 21. Flame tube 21 is relatively short and, in accordance with a feature of the invention, extends only to the end of the mixing head 29, as shown schematically by line A—A in FIG. 5, or a little therebeyond, as shown schematically by line B—B in FIG. 7. A plane across the end of the flame tube 21, thus, will be in at least approximate alignment with the disk-like deflector 31. The space 40 between the gasifier 17 and the flame tube 21 forms the recirculation space, or path for hot combustion gases back to the inlet 41 of the gasifier.

The gasifier 17 and the mixing head 29 are formed as a hollow body of axial or rotational symmetry.

FIG. 5 shows the gasifier which takes the form of a single cylindrical tube section 30 that at the front is closed by a disc 31. The disc 31 serves as a deflector section for the gas mixture. The gas mixture may issue from a plurality of outlet openings 33. In the embodiment shown, the outlet openings 33 have the form of slits. They may have also a different form, however. Because the outlet openings 33 are located in the tubular section 36 of the mixing head the gases issue from the mixing head 29 in practically radial direction. In the exemplary embodiment shown, the boundary between the gasifier 17 and the mixing head 29 is formed by a constriction 37. This constriction 37 forms a radially inwardly oriented extension 37' at the distally located outlet 42 of the gasifier 17. This inwardly oriented extension 37' prevents a flow of liquid fuel from the gasifier 17 into the mixing head 29. At the proximal end 41, that is at the inlet of the gasifier 17, an inwardly extending flange 43 prevents leakage of liquid fuel.

The unit 45 comprising the gasifier 17 and the mixing head 29 is mounted, for example with three struts 47, on an air aperture plate 35. The attachment may be by welding or riveting or the like. The struts 47 may be extensions of the tube 30. The spaces between the struts 47 form recirculation inlets 49.

The compound unit 27 is mounted on a flange 51 of the flame tube 21 (see FIGS. 5 and 7), for example by means of screws (not shown). A seal ring 53 of heat resistant material provide a practically air tight connection. This assures that the air required for combustion can only flow through the central opening 55 of the air aperture plate 35.

The gasifier 17 is surrounded by the electric heater 39. In the exemplary embodiment shown the electric heater 39 is located concentrically to the gasifier 17, but closely spaced therefrom. In this case the heating of the gasifier 17 takes place only by radiation. A better heat transfer is obtained by having the winding of the electric heater 39 in direct contact with the wall of the gasifier 17. It has proved to be advantageous to provide a means for increasing the surface area in the gasifier 17. These means, for example, may be an insert 57 made from a metal cloth. By means of a metal cloth of this kind, capillary action is brought about, which finely distributes the fuel over the inside wall of the gasifier. However, it would also be possible to provide the inner wall of the gasifier 17 with a layer of porous ceramic material. The insert 57 has an essentially radially inwardly extending flange 58 serving to catch eventual oil droplets, so that they do not enter the mixing head. At the inlet 41 of the gasifier 17 an atomizer nozzle 59 is provided. It is a hollow cone nozzle. In the embodiment according to FIG. 3, the nozzle 59 provides for different atomized fuel jets 61 having a restricted diversion angle. In order to protect these atomized fuel jets 61 from being deflected by the inflowing air, the air aperture plate 35 has a shield section 63 in the region of each atomized fuel jet 61.

Figure 7:
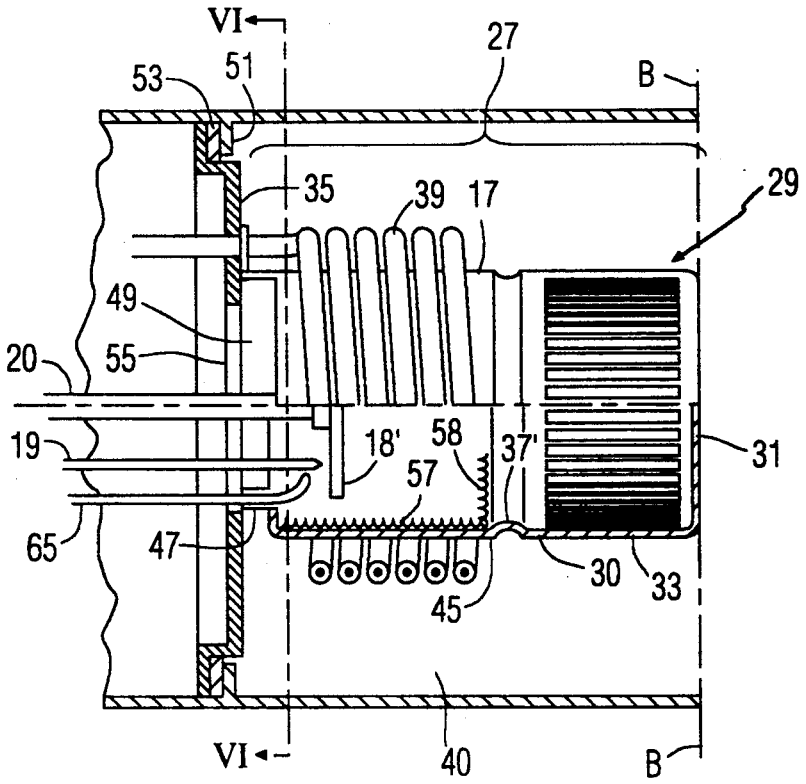
FIG. 7 is an axial view similar to FIG. 5, illustrating another embodiment.

If desired, a rotating fuel spraying or slinger device may be provided. This device can be driven by a shaft of the motor 11 (FIG. 7). The fuel line 19 extends close to the nozzle or to the rotating spraying device 18. The ignition electrodes 65 extend into the gasifier space. Ignition in the gasifier space has the advantage that on ignition, a pressure surge is substantially avoided. Accordingly, a smooth start takes place. Further, ignition is fast, because at the start higher temperatures are found in the gasifier 17 than at the outlet openings 33 of the mixing head 29.

The flame tube 21, again, serves as a recirculation path for hot combustion gases to the inlet of the gasifier.

The combination of a stationary mixing head with the outlet and deflection plate 31 has the advantage that the combination has no moving elements and, thus, is extremely reliable in operation. Recirculation of hot gases to the gasifier provides for strong heating thereof and effectively prevents coking. The high temperature of the gasifier also provides for gasification of fuel on shut-off of the burner, so that in this phase no impermissible emissions of unburned hydrocarbons take place. Of particular importance is the fact that the flame tube can be kept short without impairing the injection effect and the recirculation of hot combustion gases to the gasifier input. The mixing head at the end of the gasifier causes the flame already after a short distance to tough or impinge against the flame tube, whereupon it can exit from the flame tube and expand radially. This radial expansion provides for lowering of the flame temperature. From the view of environmental protection, a lower flame temperature has the important advantage that only few nitric oxides ($NO_x$) are formed. The mixing head has a deflector section 31 for the deflection of the outflowing gas mixture in an essentially radial direction. This permits, for the purpose of preventing formation of nitrogen oxides, use of a flame tube which is short so that the flame can immediately expand, faster than in prior art structures. Preferably, the flame tube extends to the end of the mixing head or only a little therebeyond.

Fuel may be fed into the gasifier in different ways. For example a rotating slinger or spraying device may be provided at the inlet of the gasifier. Such a rotating spraying device provides for equal distribution of the fuel in the gasifier. Particularly for burners in the upper power range, it is advisable to provide an atomizer nozzle at the inlet. This nozzle is preferably located coaxially to the gasifier. With an atomizer nozzle the fuel can be finely distributed on the gasifier walls. Of particular advantage is an atomizing nozzle of the type of a hollow cone nozzle. The atomizing nozzle may also be designed to direct at least one atomized fuel stream in form of a beam of limited divergence angle against the wall of the gasifier. In this case it is advisable that in the region of the respective atomized fuel beam the aperture plate in provided with a shield section. By this shield section the atomized fuel beam will be shielded from the inflowing air in such a way that it safely reaches the gasifier wall. Substantially no oil droplets will be entrained by the air stream and carried to the mixing head. The aperture plate is advantageously located at a distance from the gasifier, with the gap between the aperture plate and the gasifier providing a recirculation inlet. Because of this arrangement hot recirculating gases will flow primarily along the inner wall of the gasifier, whereas the cold air will flow more in the center of the gasifier. This is a good location for an ignition electrode, and further provides for excellent evaporation of the fuel and prevents evaporation of fuel after the burner stops. On switching off of the burner the gasifier is still very hot so that the remaining fuel will evaporate in a short time and burn with the air which will still be supplied until the burner comes to a final stop.

Fuel may be fed into the gasifier in different ways. For example a rotating spraying device may be provided at the inlet of the gasifier. Such a rotating spraying device provides for equal distribution of the fuel in the gasifier. Particularly for burners in the upper power range, it is advisable to provide an atomizer nozzle at the inlet. This nozzle is preferably located coaxially to the gasifier. With an atomizer nozzle the fuel can be finely distributed on the gasifier walls. Of particular advantage is an atomizing nozzle of the type of a hollow cone nozzle. The atomizing nozzle may also be designed to direct at least one atomized fuel stream of limited divergence angle against the wall of the gasifier. In this case it is advisable that in the region of the respective atomized fuel beam the aperture plate is provided with a shield section. BY this shield section the atomized fuel stream will be shielded from the inflowing air in such a away that it safely reaches the gasifier wall. Substantially no oil droplets will be entrained by the air stream and carried to the mixing head. The aperture plate is advantageously located at a distance from the gasifier, with the gap between the aperture plate and the gasifier providing a recirculation inlet. Because of this arrangement hot recirculating gases will flow primarily along the inner wall of the gasifier, whereas the cold air will flow more in the center of the gasifier. This is a good location for an ignition electrode, and further provides for excellent evaporation of the fuel and prevents evaporation of fuel after the burner stops. On switching off of the burner the gasifier is still very hot so that the remaining fuel will evaporate in a short time and burn with the air which will still be supplied until the burner comes to a final stop.

Various changes and modifications may be made, and any features described herein may be used with any of the others, within the scope of the inventive concept.

We claim:

1. A burner comprising a gasifier (17) formed as an essentially cylindrical hollow body, said gasifier including means for supplying fuel to the interior of the hollow body;

an inlet (41) for air into the hollow body at a first end of the hollow body;

an outlet (42) from the inside of the hollow body for a combustible gas-air mixture, remote from said first end of the hollow body;

a hollow mixing head (29) coupled to the outlet (42) of the gasifier (17), said mixing head intimately mixing said combustible air mixture and being formed with outlet openings (32, 33) at an outer lateral wall thereof for issuing said combustible air mixture, said mixing head (29) including a deflector section (31, 31') radially dimensioned, and positioned for deflection of said gas-air mixture through said outlet openings (32, 33) in substantially radial direction for formation of a flame after ignition of said combustible gas-air mixture which expands essentially radially from said mixing head (29); and means external of the hollow body for recirculation of hot combustion gases resulting upon formation of said flame outside of said outlet openings (33), said means comprising a flame tube (21) surrounding the gasifier (17) and the mixing head (29), while leaving a gas recirculation space (40) between the flame tube and the gasifier and the flame tube and the mixing head, said flame tube axially extending from a region near the inlet (41) approximately to the end of the mixing head (29) and arranged for recirculating the hot combustion gases to the gasifier (17) through said space (40) to the inlet to the hollow body forming the gasifier, while permitting essentially radial expansion of the flame radially beyond the flame tube.

2. The burner as claimed in claim 1, wherein said deflector section (31) is coupled to the mixing head (29).

3. The burner as claimed in claim 1, wherein the flame tube (21) extends to slightly beyond the end of the mixing head (29).

4. The burner as claimed in claim 1, wherein the gasifier (17) and the mixing head (29) form a single unit.

5. The burner as claimed in claim 1, wherein the gasifier (17) and the mixing head (29) are of tubular form.

6. The burner as claimed in claim 1, wherein an annular radially inwardly oriented ridge (37') is provided at the outlet (42) of the gasifier (17).

7. The burner as claimed in claim 1, wherein an inwardly extending flange (43) is provided at the inlet (41) of the gasifier.

8. The burner as claimed in claim 1, wherein an air aperture plate (35) with an opening (55) for the supply of air to the inlet (41) of the gasifier (17) is provided on the inlet side of the gasifier.

9. The burner as claimed in claim 1, wherein an electric heater (39) is provided for the gasifier (17).

10. The burner as claimed in claim 8, wherein an electric heater (39) is provided for the gasifier (17); and the gasifier (17), the mixing head (29), the deflection section (31), the air aperture plate (35), and the electric heater (39) form a component unit (27).

11. The burner as claimed in claim 10, wherein the flame tube (21) is arranged coaxially to and spaced apart by said space (40) from the gasifier (17) and the electric heater (39).

12. The burner as claimed in claim 8, wherein the air aperture plate (35) is located at a distance from the gasifier (17) and defines a gap therewith, and the gap between the aperture plate and the gasifier (17) forms a recirculation inlet (49, 79) for hot combustion gases to the gasifier.

13. The burner as claimed in claim 1, wherein a rotary spraying device (18') at the inlet (41) of the gasifier is provided.

14. The burner as claimed in claim 1, wherein an atomizer nozzle (59) is provided located at the inlet (41) of the gasifier (17).

15. The burner as claimed in claim 14, wherein the atomizing nozzle is a hollow cone nozzle.

16. The burner as claimed in claim 14, wherein the atomizing nozzle is designed to direct at least one atomized fuel beam (61) of limited divergence angle against a wall of the gasifier.

17. The burner as claimed in claim 16, wherein an air aperture plate (35) with an opening (55) for the supply of air to the inlet (41) of the gasifier (17) is provided on the inlet side of the gasifier; and wherein the respective regions of the atomized fuel beam (61) and the aperture plate (35) are provided with a shield section.

18. The burner as claimed in claim 1, wherein the gasifier has means (57) for increasing its effective surface area.

19. The burner as claimed in claim 18, wherein the means for increasing the surface area of the gasifier are formed by an insert (57, 65) of metal cloth that at least partially covers the inner wall of the gasifier (17).

20. The burner as claimed in claim 19, wherein said insert has a flange (58,66) protruding substantially radially inward.

21. The burner as claimed in claim 20, wherein the flange (58) of said insert (57) is located at the distal end of the gasifier (17).

22. The burner as claimed in claim 1, wherein an ignition electrode (65) is provided located at the inlet (41) to the gasifier (17).

23. The burner as claimed in claim 1, wherein said mixing head (29) and said gasifier (17) are coaxially arranged.

24. The burner as claimed in claim 1, wherein said gasifier (17) and said mixing head (29) comprise a unitary tubular structure;

and means forming a constriction (37) between the outlet from the gasifier and the mixing head for increasing turbulence in the combustible gas-air mixture formed in the gasifier and passing into the mixing head.

25. The burner as claimed in claim 1, wherein said mixing head comprises a cap-like structure having a cylindrical wall formed with said outer openings (33) therein, and a solid, essentially disk-like end wall (31), wherein said disk-like end wall forms said deflection section (31).

26. The burner as claimed in claim 1, further including an air aperture plate (35) formed with an air supply opening (55) and located adjacent the inlet (41) of the gasifier; and an ignition electrode (65) located in the path of air flow through said air supply opening (55).

27. The burner as claimed in claim 1, wherein the flame tube (21) extends axially only to the end of the mixing head (29).

28. The burner as claimed in claim 1, wherein the mixing head (29) comprises a cylindrical structure and said outlet openings (33) of the mixing head are axially extending slits formed in said cylindrical structure.

29. The burner as claimed in claim 1, wherein a fuel supply line (19') is provided, extending through the inlet (41, 53) of the gasifier (17) into the interior of the gasifier.

30. The burner as claimed in claim 1, wherein said gasifier (17) is rotatable;

a drive shaft (33) is provided, coupled to the gasifier, and a drive means (11) is provided driving said drive shaft.

31. The burner as claimed in claim 1, wherein the mixing head (29) includes a deflector part (31'), the mixing head being located spaced apart from the outlet of the gasifier (17) and having means (30') facing the gasifier for deflecting the combustible gas-air mixture to expand essentially radially from the mixing head.

32. The burner as claimed in claim 1, including an ignition electrode (41') having an electrode tip (41) located in the recirculation space (40).

33. The burner as claimed in claim 1, including an ignition electrode (41') having an electrode tip (41) located in the vicinity of said outlet openings (32, 33) of the gasifier (17).

* * * * *